US009214117B2

(12) United States Patent
Sasaki

(10) Patent No.: US 9,214,117 B2
(45) Date of Patent: Dec. 15, 2015

(54) DISPLAY CONTROL CIRCUIT, LIQUID CRYSTAL DISPLAY APPARATUS HAVING THE SAME, AND DISPLAY CONTROL METHOD

(75) Inventor: Takashi Sasaki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 60 days.

(21) Appl. No.: 14/241,455

(22) PCT Filed: Aug. 31, 2012

(86) PCT No.: PCT/JP2012/072133

§ 371 (c)(1),
(2), (4) Date: Feb. 27, 2014

(87) PCT Pub. No.: WO2013/035636

PCT Pub. Date: Mar. 14, 2013

(65) Prior Publication Data

US 2014/0210872 A1 Jul. 31, 2014

(30) Foreign Application Priority Data

Sep. 8, 2011 (JP) ..... 2011-195561

(51) Int. Cl.
*G09G 3/36* (2006.01)
*G09G 3/00* (2006.01)

(52) U.S. Cl.
CPC ..... *G09G 3/3607* (2013.01); *G09G 3/003* (2013.01); *G09G 3/3648* (2013.01); *G09G 3/36* (2013.01); *G09G 2320/0252* (2013.01)

(58) Field of Classification Search
CPC ..... G09G 3/3607; G09G 3/36; G09G 3/3648; G09G 3/003
See application file for complete search history.

(56) References Cited

U.S. PATENT DOCUMENTS 8,902,297 B2 * 12/2014 Park et al. ..... 348/51
2002/0050965 A1 5/2002 Oda et al.

(Continued)

FOREIGN PATENT DOCUMENTS

JP 2003-345318 A 12/2003
JP 2006-208770 A 8/2006

(Continued)

OTHER PUBLICATIONS

Official Communication issued in International Patent Application No. PCT/JP2012/072133, mailed on Nov. 13, 2012.

*Primary Examiner* — Abbas Abdulselam
(74) *Attorney, Agent, or Firm* — Keating & Bennett, LLP

(57) ABSTRACT

An object of the present invention is to reduce noise during three-dimensional display without increasing memory capacity in a liquid crystal display apparatus capable of displaying an image in two display modes of a 2D mode (two-dimensional display) and a 3D mode (three-dimensional display).

In an SDRAM as a volatile memory provided in a timing controller IC, data necessary for a correcting process to an input image signal is stored as follows. Overdrive data is compressed at a relatively high compression degree in the 2D mode and is compressed at a relatively low compression degree in the 3D mode, and the compressed data is stored into the SDRAM. Display unevenness correction data is compressed at a relatively low compression degree in the 2D mode and is compressed at a relatively high compression degree in the 3D mode, and the compressed data is stored into the SDRAM.

13 Claims, 8 Drawing Sheets

(56) References Cited

U.S. PATENT DOCUMENTS

| | | | |
|---|---|---|---|
| 2003/0080983 | A1 | 5/2003 | Someya et al. |
| 2005/0052387 | A1 | 3/2005 | Oda et al. |
| 2008/0165105 | A1 | 7/2008 | Okuda et al. |
| 2009/0315920 | A1 | 12/2009 | Sakurai et al. |

FOREIGN PATENT DOCUMENTS

| | | | |
|---|---|---|---|
| JP | 2006-267172 | A | 10/2006 |
| JP | 2007-010699 | A | 1/2007 |
| JP | 2008-242472 | A | 10/2008 |
| JP | 2010-002668 | A | 1/2010 |

* cited by examiner

Fig.10

CURRENT FRAME GRAY SCALE VALUE

PREVIOUS FRAME GRAY SCALE VALUE

| | 0 | ··· | 32 | ··· | 64 | ··· | 96 | ··· | 128 | ··· | 160 | ··· | 192 | ··· | 224 | ··· | 255 |
|---|---|---|---|---|---|---|---|---|---|---|---|---|---|---|---|---|---|
| 0 | 0 | ··· | 112 | ··· | 172 | ··· | 198 | ··· | 213 | ··· | 225 | ··· | 235 | ··· | 246 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 32 | 0 | ··· | 32 | ··· | 104 | ··· | 145 | ··· | 176 | ··· | 201 | ··· | 221 | ··· | 240 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 64 | 0 | ··· | 14 | ··· | 64 | ··· | 116 | ··· | 155 | ··· | 189 | ··· | 214 | ··· | 238 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 96 | 0 | ··· | 9 | ··· | 43 | ··· | 96 | ··· | 141 | ··· | 179 | ··· | 209 | ··· | 236 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 128 | 0 | ··· | 6 | ··· | 27 | ··· | 78 | ··· | 128 | ··· | 170 | ··· | 204 | ··· | 234 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 160 | 0 | ··· | 4 | ··· | 20 | ··· | 60 | ··· | 114 | ··· | 160 | ··· | 198 | ··· | 231 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 192 | 0 | ··· | 2 | ··· | 14 | ··· | 44 | ··· | 100 | ··· | 150 | ··· | 192 | ··· | 228 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 224 | 0 | ··· | 0 | ··· | 10 | ··· | 28 | ··· | 79 | ··· | 137 | ··· | 184 | ··· | 224 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 255 | 0 | ··· | 0 | ··· | 6 | ··· | 18 | ··· | 56 | ··· | 116 | ··· | 170 | ··· | 219 | ··· | 255 |

DISPLAY CONTROL CIRCUIT, LIQUID CRYSTAL DISPLAY APPARATUS HAVING THE SAME, AND DISPLAY CONTROL METHOD

TECHNICAL FIELD

The present invention relates to a display control circuit for displaying input image data which is supplied from the outside, a liquid crystal display apparatus having the same, and a display control method and, more particularly, to a display control circuit for displaying an image in two display modes of two-dimensional display and three-dimensional display on the basis of input image data, a liquid crystal display apparatus having the same, and a display control method.

BACKGROUND ART

In recent years, reduction in weight and thickness of a display of a personal computer, a television, and the like is in strong demand and a liquid crystal display apparatus which easily realizes lighter weight and reduced thickness is being rapidly employed as such a display. However, since response speed of liquid crystal is low, there is a case that sufficient picture quality is not obtained when a moving image is displayed in a liquid crystal display apparatus. To suppress deterioration in picture quality at the time of displaying a moving image caused by low response speed of liquid crystal, conventionally, a drive method called overdrive (or overshoot drive) is employed. The overdrive is a driving method of supplying a drive voltage higher than a gray scale voltage corresponding to an input image signal of a current frame or a drive voltage lower than a gray scale voltage corresponding to the input image signal of the current frame to a liquid crystal display panel in accordance with a combination of an input image signal of an immediate previous frame and an input image signal of the current frame. By employing such overdrive, time until voltage reaches the gray scale voltage corresponding to the input image signal of the current frame is shortened, and deterioration in the picture quality at the time of displaying a moving image is suppressed.

In a liquid crystal display apparatus employing the overdrive, a look-up table (hereinbelow, called an overdrive look-up table) is held so that a drive voltage is determined on the basis of a combination of a gray scale value corresponding to an input image signal of an immediately preceding frame (hereinbelow, called "a previous frame gray scale value") and a gray scale value corresponding to an input image signal of the current frame (hereinbelow, called "a current frame gray scale value"). FIG. 10 is a diagram schematically illustrating an example of an overdrive look-up table held in a liquid crystal display apparatus capable of performing 256-gray scale display. In FIG. 10, the numerical values written in the leftmost column indicate previous frame gray scale values, and the numerical values written in the uppermost row indicate current frame gray scale values. A numerical value written in an intersection position of a row and a column indicates a gray scale value (hereinbelow, called "application gray scale value") corresponding to a drive voltage determined on the basis of the combination of a previous frame gray scale value and a current frame gray scale value. For example, in the case where the previous frame gray scale value is "64" and the current frame gray scale value is "128", the application gray scale value is "155". For example, in the case where the previous frame gray scale value is "160" and the current frame gray scale value is "64", the application gray scale value is "20". In such a manner, on the basis of data stored in the overdrive look-up table, the drive voltage higher than the gray scale voltage corresponding to the input image signal of the current frame or the drive voltage lower than the gray scale voltage corresponding to the input image signal of the current frame is applied to the liquid crystal.

As described above, when the overdrive is performed, the application gray scale value is determined in accordance with the overdrive look-up table on the basis of the combination of the previous frame gray scale value and the current frame gray scale value. Consequently, the previous frame gray scale values of one frame have to be held. Accordingly, usually, in the liquid crystal display apparatus employing the overdrive, a volatile memory (for example, SDRAM) for holding the previous frame gray scale values of one frame is provided. It should be noted that such a volatile memory holding the gray scale values of one frame is generally called a "frame memory".

As the resolution of a liquid crystal display apparatus becomes higher, the capacity of the above-described frame memory has to be increased. When the number of display pixels increases as the resolution becomes higher, the amount of data related to writing to the frame memory and reading from the frame memory in one frame period increases, so that the data transfer speed has to be increased. Consequently, the cost rises. Regarding the liquid crystal display apparatus employing the overdrive, for example, in the invention disclosed in Japanese Patent Application Laid-Open No. 2006-208770, to reduce the capacity of the frame memory, image data is encoded (compressed) and then the encoded image data is written in the frame memory. In an image processing apparatus described in Japanese Patent Application Laid-Open No. 2006-208770, at the time of quantizing image data of a current frame block by block and then outputting encoded image data, the number of quantization bits of the image data is adjusted on the basis of the dynamic range of each block.

In addition to the Japanese Patent Application Laid-Open No. 2006-208770, the following prior art documents related to the present invention are known. Japanese Patent Application Laid-Open No. 2010-2668 discloses a technique of suppressing residual image noise which occurs when input image data is corrected on the basis of image data which is irreversibly compressed and then decoded. Japanese Patent Application Laid-Open No. 2006-267172 discloses a technique of suppressing deterioration in the picture quality while suppressing the memory capacity in a liquid crystal display apparatus performing the overdrive. In addition, Japanese Patent Application Laid-Open Nos. 2008-242472, 2003-345318, 2007-10699, and the like also disclose a technique of reducing the memory capacity in a liquid crystal display apparatus.

PRIOR ART DOCUMENTS

Patent Documents

[Patent Document 1] Japanese Patent Application Laid-Open No. 2006-208770

[Patent Document 2] Japanese Patent Application Laid-Open No. 2010-2668

[Patent Document 3] Japanese Patent Application Laid-Open No. 2006-267172

[Patent Document 4] Japanese Patent Application Laid-Open No. 2008-242472

[Patent Document 5] Japanese Patent Application Laid-Open No. 2003-345318

[Patent Document 6] Japanese Patent Application Laid-Open No. 2007-10699

SUMMARY OF THE INVENTION

Problems to be Solved by the Invention

In recent years, development of a liquid crystal display apparatus capable of displaying an image in two display modes of two-dimensional display and three-dimensional display (so-called "3D display") is conspicuous. In such a liquid crystal display apparatus, at the time of three-dimensional display, even when a display image is a still picture, the liquid crystal is driven in a manner similar to display of a moving image in order to generate a parallax between the right and left eyes of a watcher. Therefore, at the time of three-dimensional display, even when a display image is a still picture, overdrive is performed. When the configuration is such that data compression is performed at the time of overdrive in order to decrease the memory capacity, there is a case that noise caused by a compression error (the difference between data before compression and data decoded) is conspicuous. One measure is that data compression is not performed. However, in this case, the memory capacity necessary increases, and the cost becomes high.

In Japanese Patent Application Laid-Open No. 2006-208770, although there is a description "encoding error is reduced", switching between the two-dimensional display and the three-dimensional display is not considered. In the case where it is designed for two-dimensional display, there is a possibility of deterioration in the display quality during the three-dimensional display. On the contrary, in the case where it is designed for three-dimensional display, the performance is excessive for the two-dimensional display, and it is not efficient.

An object of the present invention is to reduce noise at the time of three-dimensional display without increasing memory capacity in a liquid crystal display apparatus capable of displaying an image in two display modes of two-dimensional display and three-dimensional display.

Means for Solving the Problems

A first aspect of the present invention is directed to a display control circuit for generating write gray scale data to be supplied to a display panel capable of displaying an image in two display modes of two-dimensional display and three-dimensional display, based on an image signal sent from an outside, the display control circuit comprising:

a display unevenness correcting unit performing a correction to the image signal for suppressing occurrence of display unevenness at the time of displaying an image on the display panel;

an overdrive unit performing a correction for emphasizing a temporal change of a signal to the image signal corrected by the display unevenness correcting unit, and generating the write gray scale data; and a volatile memory for storing display unevenness correction data as data used for a process by the display unevenness correcting unit and overdrive data as data used for a process by the overdrive unit, wherein when a capacity for storing the display unevenness correction data out of a capacity of the volatile memory is defined as a first capacity, and a capacity for storing the overdrive data out of the capacity of the volatile memory is defined as a second capacity, the first capacity during the two-dimensional display is larger than that during the three-dimensional display, and the second capacity during the three-dimensional display is larger than that during the two-dimensional display.

According to a second aspect of the present invention, in the first aspect of the present invention, the display unevenness correction data compressed at a compression ratio which varies depending on a display mode is stored in the first capacity, and the overdrive data compressed at a compression ratio which varies depending on a display mode is stored in the second capacity.

According to a third aspect of the present invention, in the second aspect of the present invention, the overdrive unit compresses the write gray scale data at a compression ratio which varies depending on a display mode and writes the compressed write gray scale data as a part of the overdrive data into the volatile memory.

According to a fourth aspect of the present invention, in the second aspect of the present invention, a mode signal indicative of a display mode is supplied to the display unevenness correcting unit and the overdrive unit, the display unevenness correcting unit restores the display unevenness correction data stored in the volatile memory in accordance with a display mode indicated by the mode signal, and the overdrive unit restores the overdrive data stored in the volatile memory in accordance with a display mode indicated by the mode signal.

According to a fifth aspect of the present invention, in the second aspect of the present invention, a mode signal indicative of a display mode is supplied to the display unevenness correcting unit and the overdrive unit, the display unevenness correcting unit restores the display unevenness correction data stored in the volatile memory in accordance with a display mode indicated by the mode signal, and the overdrive unit compresses the write gray scale data at a compression ratio in accordance with a display mode indicated by the mode signal, writes the compressed write gray scale data as a part of the overdrive data into the volatile memory, and restores the overdrive data stored in the volatile memory in accordance with a display mode indicated by the mode signal.

According to a sixth aspect of the present invention, in the first aspect of the present invention, when three-dimensional display is performed, a process by the display unevenness correcting unit is stopped, and the magnitude of the first capacity is set to zero.

According to a seventh aspect of the present invention, in the first aspect of the present invention, when two-dimensional display is performed, a process by the overdrive unit is stopped, and the magnitude of the second capacity is set to zero.

An eighth aspect of the present invention is directed to a liquid crystal display apparatus comprising:

the display control circuit according to any one of the first to seventh aspects; and a liquid crystal display panel for displaying an image based on write gray scale data supplied from the display control circuit, the liquid crystal display panel including a plurality of video signal lines for transmitting a plurality of video signals corresponding to the write gray scale data, a plurality of scanning signal lines crossing the plurality of video signal lines, a plurality of pixel formation portions disposed in a matrix along the plurality of video signal lines and the plurality of scanning signal lines, a common electrode for supplying a common potential to the plurality of pixel formation portions, a video signal line drive circuit for driving the plurality of video signal lines, and a scanning signal line drive circuit for driving the plurality of scanning signal lines.

According to a ninth aspect of the present invention, in the eighth aspect of the present invention, the liquid crystal display apparatus further comprises a nonvolatile memory in which display unevenness correction data for two-dimensional display and display unevenness correction data for three-dimensional display compressed at compression ratios different from each other are stored, wherein when a power supply is turned on or when the display mode is switched, the display unevenness correction data in accordance with the display mode is read from the nonvolatile memory, and the read display unevenness correction data is written into the volatile memory.

According to a tenth aspect of the present invention, in the ninth aspect of the present invention, a look-up table which configures a part of the overdrive data is further stored in the nonvolatile memory, and when a power supply is turned on, the look-up table is read from the nonvolatile memory, and the read look-up table is written into the volatile memory.

According to an eleventh aspect of the present invention, in the eighth aspect of the present invention, the liquid crystal display apparatus further comprises n pieces (n denotes an integer of two or larger) of the display control circuits integrated, wherein each of the display control circuits generates write gray scale data corresponding to an image to be displayed in a region of substantially 1/n of an image display region of the liquid crystal display panel.

According to a twelfth aspect of the present invention, in the eleventh aspect of the present invention, the n is two and a frame frequency is 240 Hz.

A thirteenth aspect of the present invention is directed to a display control method of generating write gray scale data to be supplied to a display panel capable of displaying an image in two display modes of two-dimensional display and three-dimensional display based on an image signal sent from an outside, the display control method comprising:

a display unevenness correcting step of performing a correction to the image signal for suppressing occurrence of display unevenness at the time of displaying an image on the display panel; and an overdrive step of performing a correction for emphasizing a temporal change of a signal to the image signal corrected in the display unevenness correcting step, and generating the write gray scale data, wherein when a capacity for storing display unevenness correction data out of a capacity of the volatile memory is defined as a first capacity, and a capacity for storing overdrive data out of the capacity of the volatile memory is defined as a second capacity, the volatile memory being provided for storing the display unevenness correction data as data used for a process in the display unevenness correcting step and the overdrive data as data used for a process in the overdrive step, the first capacity during the two-dimensional display is larger than that during the three-dimensional display, and the second capacity during the three-dimensional display is larger than that during the two-dimensional display.

Effects of the Invention

According to the first aspect of the present invention, regarding the capacity of the volatile memory provided for the display control circuit, a larger region is used as a storage region for overdrive data during the three-dimensional display than that during the two-dimensional display. Consequently, occurrence of a noise which is caused by a compression error and visually recognized at the time of three-dimensional display is suppressed. At the time of three-dimensional display, the display unevenness correction data of the amount smaller than that during the two-dimensional display is stored in the volatile memory. Regarding this point, glasses for watching a three-dimensional image are used and a black image is inserted at the time of the three-dimensional display, so that the brightness is lower than that during the two-dimensional display. Consequently, at the time of the three-dimensional display, display unevenness is not easily visually recognized. Therefore, even when the amount of the display unevenness correction data which is stored in the volatile memory at the time of three-dimensional display is small, the display quality does not largely deteriorate. As a result, without increasing the memory capacity, noise at the time of the three-dimensional display in the display panel capable of displaying an image in two display modes of two-dimensional display and three-dimensional display can be reduced.

According to the second aspect of the present invention, by adopting such a configuration that the overdrive data and the display unevenness correction data which are compressed at a compression ratio which varies depending on a display mode are stored into the volatile memory in the display control circuit, noise at the time of three-dimensional display can be reduced without increasing the memory capacity.

According to the third aspect of the present invention, by adopting such a configuration that the write gray scale data compressed at a compression ratio which varies depending on a display mode is stored into the volatile memory in the display control circuit, noise at the time of three-dimensional display can be reduced without increasing the memory capacity.

According to the fourth aspect of the present invention, with respect to the display unevenness correction unit and the overdrive unit, with a relatively simple configuration, the operation at the time of two-dimensional display and that at the time of three-dimensional display can be made different.

According to the fifth aspect of the present invention, like the fourth aspect of the present invention, with respect to the display unevenness correction unit and the overdrive unit, with a relatively simple configuration, the operation at the time of two-dimensional display and that at the time of three-dimensional display can be made different.

According to the sixth aspect of the present invention, the display unevenness correction data for three-dimensional display is unnecessary. Consequently, effects of improvement in production efficiency and reduction in cost are obtained.

According to the seventh aspect of the present invention, since the overdrive is not performed at the time of two-dimensional display, the process load is reduced.

According to the eighth aspect of the present invention, in the liquid crystal display apparatus capable of displaying an image in two display modes of two-dimensional display and three-dimensional display, noise at the time of three-dimensional display can be reduced without increasing the memory capacity.

According to the ninth aspect of the present invention, it is unnecessary to preliminarily store the display unevenness correction data for two-dimensional display and display unevenness correction data for three-dimensional display in the display control circuit. Further, the contents of the display unevenness correction data can be rewritten from the outside relatively easily.

According to the tenth aspect of the present invention, it is unnecessary to preliminarily store the overdrive look-up table in the display control circuit. Further, the contents of the look-up table can be rewritten from the outside relatively easily.

According to the eleventh aspect of the present invention, it is sufficient for one display control circuit to perform a process for the region of 1/n of the liquid crystal display panel. Consequently, regarding the volatile memory in each display control circuit, a larger region is used as the storage region for the overdrive data. Therefore, in a liquid crystal display apparatus capable of displaying an image in two display modes of two-dimensional display and three-dimensional display, noise at the time of three-dimensional display can be reduced more effectively.

According to the twelfth aspect of the present invention, in the liquid crystal display apparatus performing quad-speed drive by using two integrated display control circuits, noise at the time of three-dimensional display can be reduced more effectively.

According to the thirteenth aspect of the present invention, effects similar to those of the first aspect of the present invention can be produced in the invention of the display control method.

BRIEF DESCRIPTION OF THE DRAWINGS

FIG. 10 is a diagram schematically illustrating an example of an overdrive look-up table held in a liquid crystal display apparatus capable of performing 256-gray scale display.

MODES FOR CARRYING OUT THE INVENTION

Hereinafter, embodiments of the present invention will be described with reference to attached drawings. It should be noted that "Compression ratio" in the description is a ratio of a data size after compression to a data size before compression. For example, when the data size before compression is 10 M (mega) bits and the data size after compression is 1 Mbit, the compression ratio is "1/10". In the description, to express the degree of the compression ratio, a term "compression degree" will be used. It is assumed that when the compression degree is high, the value of the compression ratio is small. For example, when compared to the compression ratios "1/3" and "1/4", the compression ratio "1/4" is higher in the compression degree.

1. First Embodiment

1.1 General Configuration and Operation Outline

Figure 2:
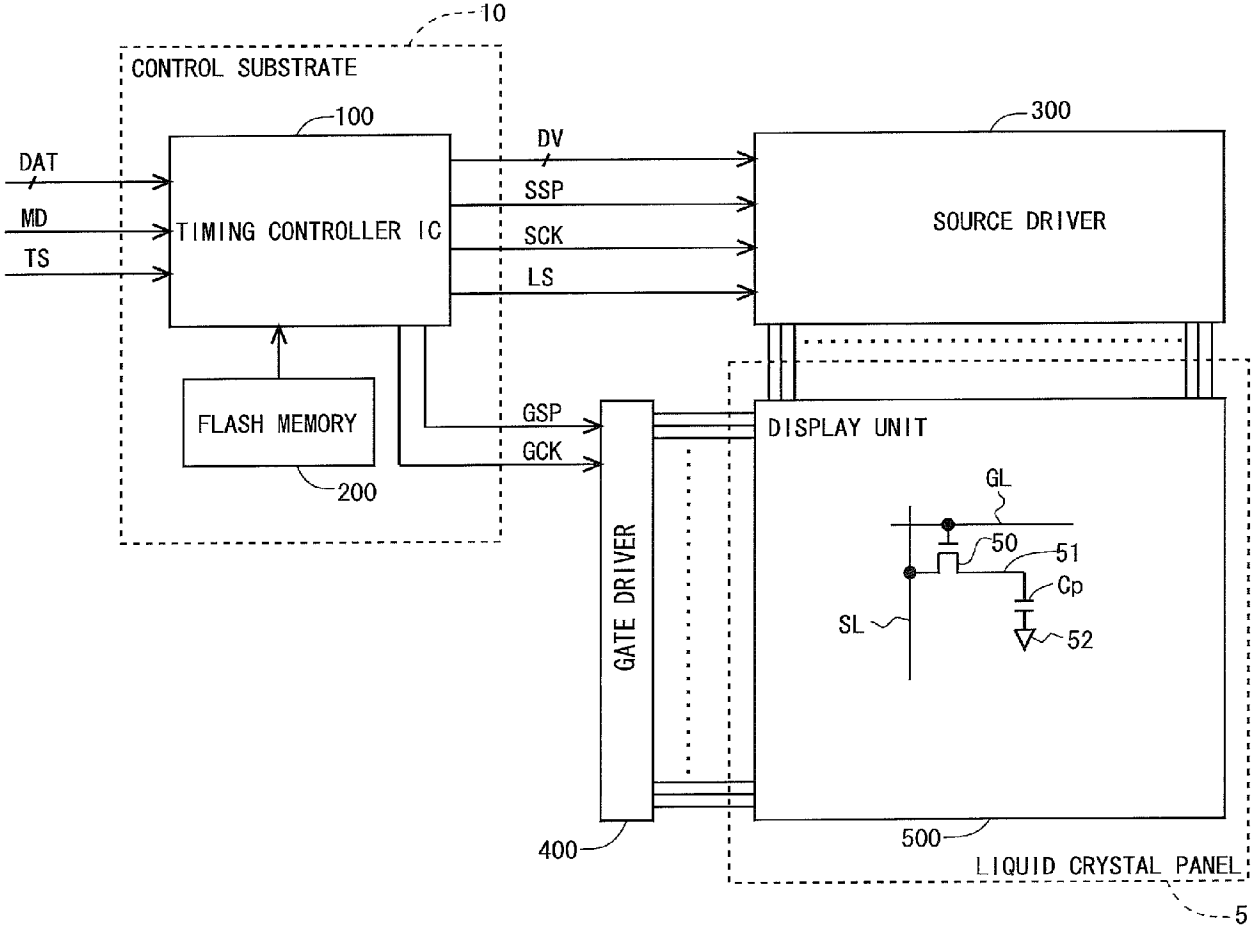
FIG. 2 is a block diagram illustrating a general configuration of the liquid crystal display apparatus in the first embodiment.

FIG. 2 is a block diagram illustrating a general configuration of the liquid crystal display apparatus in a first embodiment of the present invention. The liquid crystal display apparatus includes a liquid crystal panel 5 having a display unit 500, a control substrate 10 on which a timing controller IC 100 as a display control circuit and a flash memory 200 as a nonvolatile memory are mounted, a source driver (video signal line drive circuit) 300, and a gate driver (scanning signal line drive circuit) 400. It should be noted that the source driver 300 and/or the gate driver 400 may be included in the liquid crystal panel 5. That is, the source driver 300 and/or the gate driver 400 may be formed monolithically on a glass substrate constituting the liquid crystal panel 5.

In the liquid crystal display apparatus, two display modes of two-dimensional display and three-dimensional display are prepared, and the display unit 500 of the liquid crystal panel 5 can display an image in the two-dimensional display or three-dimensional display in accordance with a display mode. It should be noted that, in the following, a display mode in which the two-dimensional display is performed will be called a "2D mode" and a display mode in which the three-dimensional display is performed will be called a "3D mode".

In the display unit 500, a plurality of source bus lines (video signal line) SL and a plurality of gate bus lines (scan signal lines) GL are disposed. In correspondence with an intersecting point of the source bus line SL and the gate bus line GL, a pixel formation portion forming a pixel is provided. That is, the display unit 500 includes a plurality of pixel formation portions. The plurality of pixel formation portions are disposed in a matrix to construct a pixel array. Each of the pixel formation portions includes a thin film transistor (TFT) 50 as a switching element whose gate terminal is connected to the gate bus line GL passing a corresponding intersecting point and whose source terminal is connected to the source bus line SL passing the intersecting point, a pixel electrode 51 connected to the drain terminal of the thin film transistor 50, a common electrode 52 as an opposite electrode for applying common potential to the plurality of pixel formation portions, and a liquid crystal layer commonly provided for the plurality of pixel formation portions and sandwiched by the pixel electrode 51 and the common electrode 52. By a liquid crystal capacitance formed by the pixel electrode 51 and the common electrode 52, a pixel capacitance Cp is constituted. Generally, an auxiliary capacitance is provided in parallel to the liquid crystal capacitance to reliably hold voltage in the pixel capacitance Cp. Since the auxiliary capacitance, however, is not directly related to the present invention, its description and illustration will not be given. It should be noted that, in the display unit 500 in FIG. 2, only the components corresponding to one pixel formation portion are illustrated.

Next, the operation of the components illustrated in FIG. 2 will be described. The timing controller IC 100 receives an image signal DAT, a timing signal TS such as a horizontal synchronization signal or a vertical synchronization signal, and a mode signal MD indicative of the display mode from the outside, performs a predetermined correcting process on the image signal DAT, and outputs a digital video signal DV, a source start pulse signal SSP, a source clock signal SCK, and a latch strobe signal LS which are for controlling the operation of the source driver 300, and a gate start pulse signal GSP and a gate clock signal GCK which are for controlling the operation of the gate driver 400. It should be noted that, immediately after power-on or upon switching the display mode, the timing controller IC 100 reads data necessary for the correcting process from the flash memory 200 as a non-volatile memory and writes the read data into an internal volatile memory.

The source driver 300 receives the digital video signal DV, the source start pulse signal SSP, the source clock signal SCK, and the latch strobe signal LS which are output from the timing controller IC 100 and applies a drive video signal to each of the source bus lines SL. At this time, in the source driver 300, at a timing when the pulse of the source clock signal SCK is generated, the digital video signal DV indicative of a voltage to be applied to each source bus line SL is sequentially held. At a timing when the pulse of the latch strobe signal LS is generated, the held digital video signals DV are converted to analog voltages. The converted analog voltages are applied as drive video signals at once to all of the source bus lines SL. On the basis of the gate start pulse signal GSP and the gate clock signal GCK which are output from the timing controller IC 100, the gate driver 400 repeats application of an active scan signal to each of the gate bus lines GL using one vertical scanning period as a cycle.

The drive video signal is applied to each of the source bus lines SL and the scan signal is applied to each of the gate bus lines GL as described above, thereby displaying an image based on the image signal DAT sent from the outside in the display unit 500 of the liquid crystal panel 5 in a mode in accordance with the display mode.

1.2 Configuration of Timing Controller IC

Figure 3:
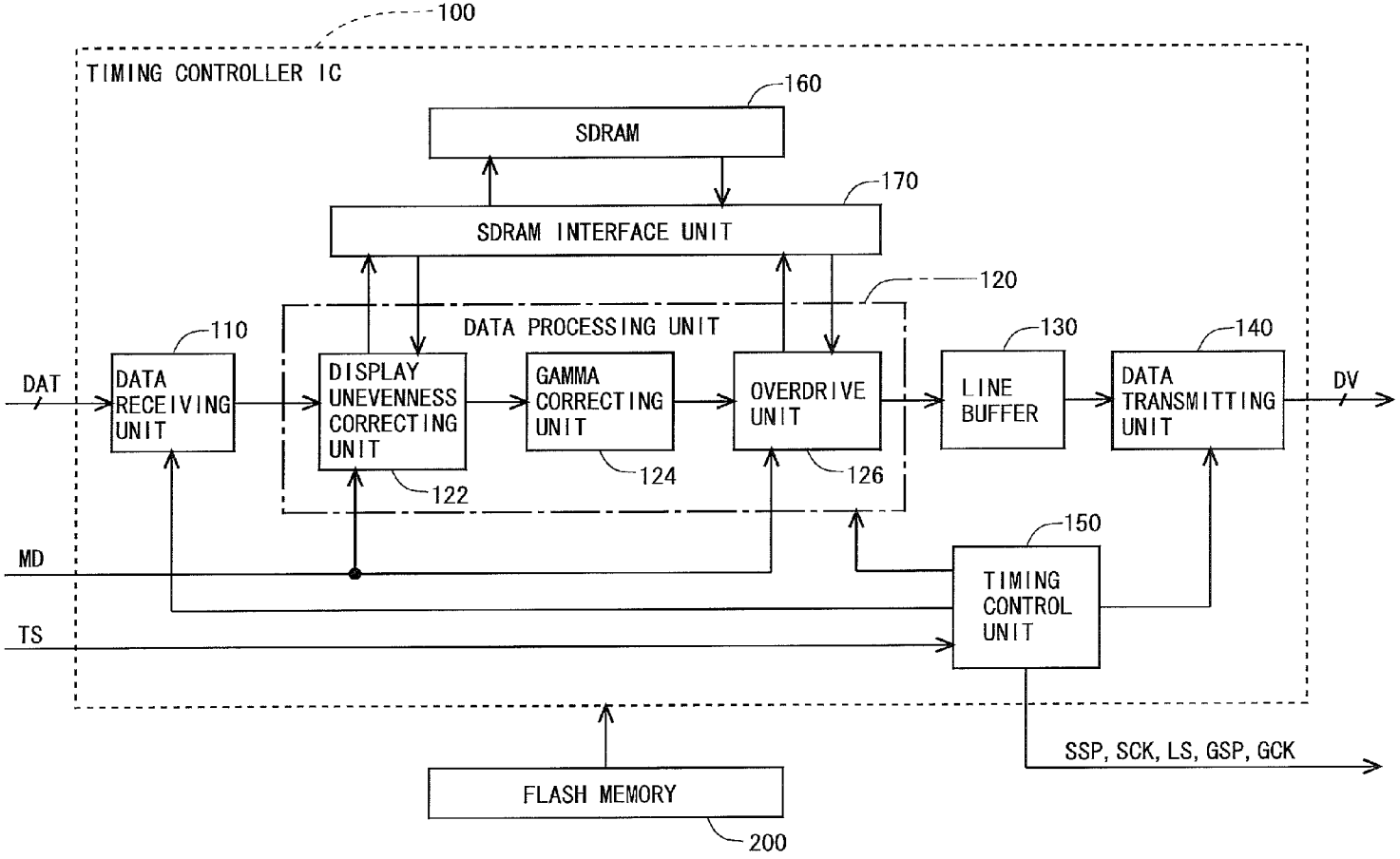
FIG. 3 is a block diagram illustrating a functional configuration of a timing controller IC in the first embodiment.

FIG. 3 is a block diagram illustrating a functional configuration of the timing controller IC 100 in the present embodiment. The timing controller IC 100 has a data receiving unit 110, a data processing unit 120, a line buffer 130, a data transmitting unit 140, a timing control unit 150, an SDRAM. 160, and an SDRAM interface unit 170. The data processing unit 120 includes a display unevenness correcting unit 122, a gamma correcting unit 124, and an overdrive unit 126.

The data receiving unit 110 receives the image signal DAT sent from the outside and supplies it to the data processing unit 120. It should be noted that, as the interface in the data receiving unit 110, for example, an LVDS (Low Voltage Differential Signaling) is employed.

The display unevenness correcting unit 122 in the data processing unit 120 performs a correction (hereinbelow, called "display unevenness correction") to the image signal DAT for suppressing occurrence of display unevenness at the time of displaying an image in the display unit 500. In the display unevenness correction, the brightness is digitally adjusted with addition or subtraction of a value which varies by each position (each pixel) so that the brightness distribution in the screen of the display unit 500 becomes even. The operation which varies depending on the display mode indicated by the mode signal MD is performed, which will be described later.

The gamma correcting unit 124 in the data processing unit 120 performs a known gamma correction in accordance with the characteristics of the liquid crystal panel 5 used. It should be noted that the present embodiment employs the configuration that the gamma correction is performed after the display unevenness correction. However, the invention is not limited to this. A configuration that the gamma correction is performed before the display unevenness correction may be employed.

Figure 4:
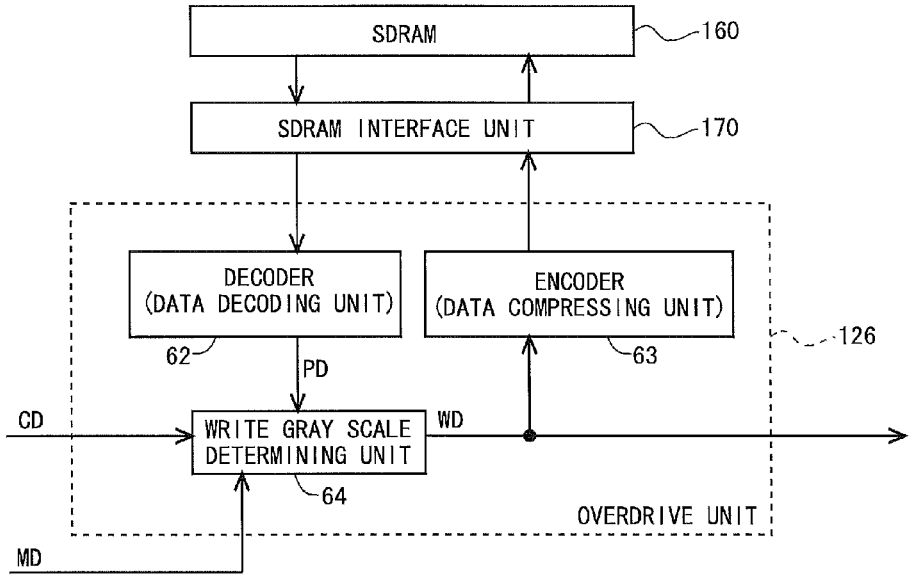
FIG. 4 is a block diagram for specifically explaining an overdrive unit in the first embodiment.

The overdrive unit 126 in the data processing unit 120 performs a correction for emphasizing a temporal change of a signal to the image signal subjected to the display unevenness correction and the gamma correction, generates write gray scale data indicative of an application gray scale value in each of the pixel formation portions, and outputs the write gray scale data to the line buffer 130. FIG. 4 is a block diagram for specifically explaining the overdrive unit 126. As illustrated in FIG. 4, the overdrive unit 126 includes a decoder (data decoding unit) 62, an encoder (data compressing unit) 63, and a write gray scale determining unit 64. The encoder 63 encodes write gray scale data WD generated by the write gray scale determining unit 64 and outputs the encoded data to the SDRAM interface unit 170. As a result, the write gray scale data WD is written into the SDRAM 160 in a compressed state. At this time, the write gray scale data WD is compressed at a compression ratio which varies depending on the display mode indicated by the mode signal MD. The decoder 62 decodes write gray scale data PD of the immediately preceding frame (hereinbelow, called "previous frame data") read from the SDRAM 160 via the SDRAM interface unit 170. It should be noted that the previous frame data PD is data indicative of the above-described previous frame gray scale value. The decoding is performed in accordance with the display mode indicated by the mode signal MD. The write gray scale determining unit 64 determines an application gray scale value with reference to the above-described overdrive look-up table (refer to FIG. 10) based on the previous frame data PD and the input data CD to this write gray scale determining unit 64, and outputs the application gray scale value as the write gray scale data WD. It should be noted that the input data CD is data subjected to the display unevenness correction and the gamma correction and is data indicative of the above-described current frame gray scale value.

In the line buffer 130, the write gray scale data WD of one line which is output from the write gray scale determining unit 64 is held. The data transmitting unit 140 takes the write gray scale data WD from the line buffer 130 and outputs it as the digital video signal DV. It should be noted that, as the interface of the data transmitting unit 140, for example, mini-LVDS or CalDriCon (registered trademark in Japan) is employed.

On the basis of the timing signal TS sent from the outside, the timing control unit 150 controls the operation of the data receiving unit 110, the data processing unit 120, and the data transmitting unit 140 and outputs the source start pulse signal SSP, the source clock signal SCK, the latch strobe signal LS, the gate start pulse signal GSP, and the gate clock signal GCK.

The SDRAM 160 is a volatile memory. In the SDRAM 160, data used for the display unevenness correction by the display unevenness correcting unit 122 (hereinbelow, called "display unevenness correction data") and data used for a process by the overdrive unit 126 (hereinbelow, called "overdrive data") are stored. As described above, the display unevenness correction is a process for digitally adjusting brightness by adding/subtracting a value which varies depending on each place (each pixel). Therefore, the display unevenness correction data is constructed by, for example, position information, gray scale information, color information, and an addition/subtraction value. The overdrive data is constructed by data to be read from the SDRAM 160 as the previous frame data PD and the overdrive look-up table.

The SDRAM interface unit 170 functions as an interface between the data processing unit 120 and the SDRAM 160 at the time of writing data to the SDRAM 160 and reading data from the SDRAM 160.

On the control substrate 10 on which the timing controller IC 100 is mounted, the flash memory 200 is also mounted. In the flash memory 200, at least the display unevenness correction data and the overdrive look-up table (refer to FIG. 10) as a part of the overdrive data are stored. Since the flash memory 200 is nonvolatile, even when the power supply of the device is set to the off state, the contents of the display unevenness correction data and the contents of the overdrive look-up table are not erased. It should be noted that, by employing such a configuration that the display unevenness correction data and the overdrive look-up table are written in the flash memory 20, not in the timing controller IC 100, the contents of the display unevenness correction data and the contents of the overdrive look-up table can be relatively easily rewritten from the outside. Further, it becomes unnecessary to preliminarily provide the display unevenness correction data and the overdrive look-up table in the timing controller IC 100.

1.3 Operation

Figure 1:
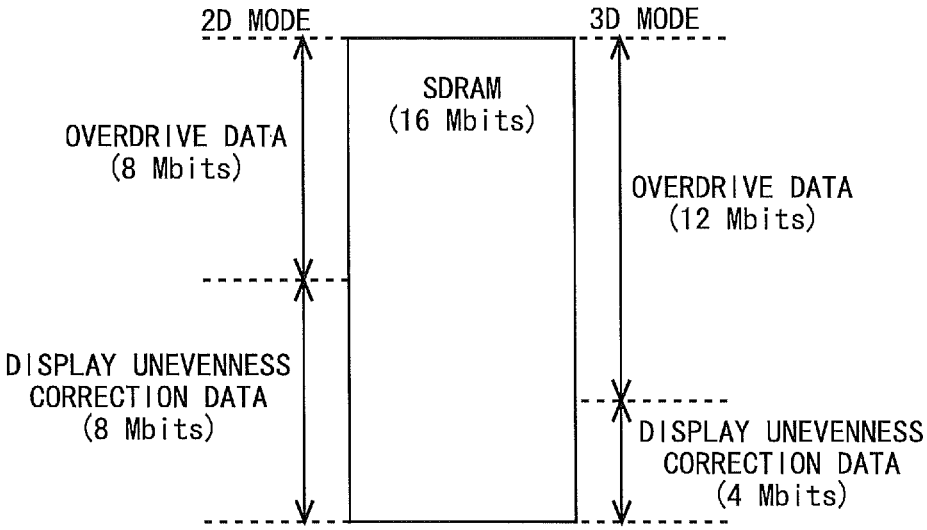
FIG. 1 is a diagram for explaining a use of an SDRAM in a liquid crystal display apparatus according to a first embodiment of the present invention.
Figure 5:
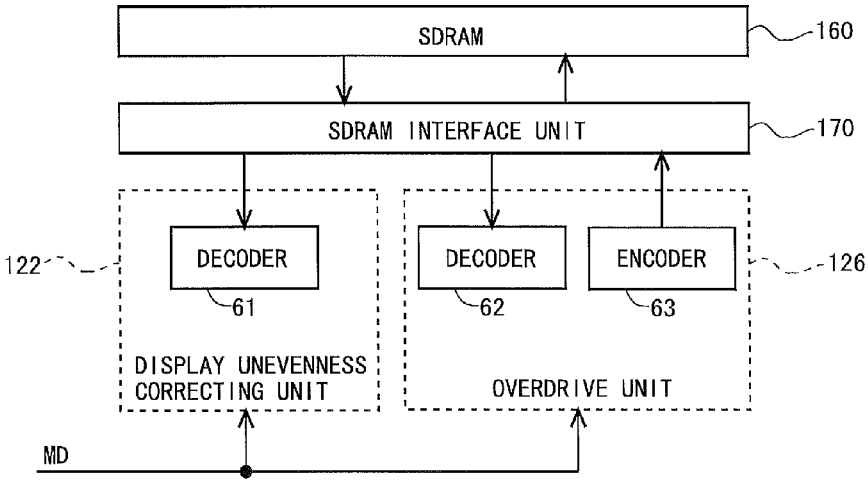
FIG. 5 is a block diagram schematically illustrating the configuration of a main part in the first embodiment.

Next, with reference to FIGS. 1 and 5, the difference between the operation during the 2D mode and the operation during the 3D mode will be described. FIG. 1 is a diagram for explaining the use of the SDRAM 160 in the present embodiment. FIG. 5 is a block diagram schematically illustrating the configuration of a main part in the present embodiment. As illustrated in FIG. 5, in the present embodiment, the mode signal MD indicating that the display mode is the 2D mode or the 3D mode is supplied to the display unevenness correcting unit 122 and the overdrive unit 126. Consequently, the display unevenness correcting unit 122 and the overdrive unit 126 can perform the operation which varies between the 2D mode and the 3D mode.

Immediately after turn-on of the power supply of the device, the timing controller IC 100 reads the display unevenness correction data and the overdrive look-up table from the flash memory 200 and writes them into the SDRAM 160 inside the timing controller IC 100 (refer to FIG. 3). When the default of the display mode is set to the 2D mode, the display unevenness correction data compressed at a relatively low compression degree for the two-dimensional display is read from the flash memory 200 and written into the SDRAM 160. On the other hand, when the default of the display mode is set to the 3D mode, the display unevenness correction data compressed at a relatively high compression degree for the three-dimensional display is read from the flash memory 200 and written into the SDRAM 160. The overdrive look-up table in the case where the default of the display mode is 2D mode, and the overdrive look-up table in the case where the default of the display mode is 3D mode may be the same or different from each other.

1.3.1 Operation During 2D Mode

When the display mode is switched from the 3D mode to the 2D mode, first, the display unevenness correction data for two-dimensional display is read from the flash memory 200, and the read display unevenness correction data is written into the SDRAM 160 via the SDRAM interface unit 170. At this time, the capacity of 8 Mbits out of the capacity of 16 Mbits of the SDRAM 160 is used as the region for the display unevenness correction data (refer to FIG. 1).

After completion of writing of the display unevenness correction data for two-dimensional display into the SDRAM 160, the display unevenness correcting unit 122 and the overdrive unit 126 operate as follows. The display unevenness correcting unit 122 performs a correcting operation process on an input image signal while reading the display unevenness correction data from the SDRAM 160 via the SDRAM interface unit 170. At this time, the decoder 61 decodes the display unevenness correction data in accordance with the display mode. Specifically, in consideration that the display unevenness correction data stored in the SDRAM 160 is compressed at a compression ratio for two-dimensional display (the relatively low compression degree), the display unevenness correction data is decoded. On the basis of the data subjected to the gamma correction by the gamma correcting unit 124 and the data of the immediately preceding frame (previous frame data) stored in the SDRAM 160, the overdrive unit 126 generates write gray scale data with reference to the overdrive look-up table. At this time, the decoder 62 decodes the previous frame data in accordance with the display mode. Specifically, in consideration that the previous frame data stored in the SDRAM 160 is compressed at the compression ratio for two-dimensional display (the relatively high compression degree), the previous frame data is decoded. The overdrive unit 126 writes the generated write gray scale data into the SDRAM 160 so as to be provided for a process in the following frame. At this time, the encoder 63 encodes the write gray scale data in accordance with the display mode. That is, the write gray scale data is compressed at the compression ratio for two-dimensional display (the relatively high compression degree). By compressing the write gray scale data of one frame at the relatively high compression degree and writing the compressed data into the SDRAM 160, the capacity of 8 Mbits out of the 16 Mbits of the SDRAM 160 is used as the region for the overdrive data (refer to FIG. 1).

1.3.2 Operation during 3D Mode

When the display mode is switched from the 2D mode to the 3D mode, first, the display unevenness correction data for three-dimensional display is read from the flash memory 200, and the read display unevenness correction data is written into the SDRAM 160 via the SDRAM interface unit 170. At this time, the capacity of 4 Mbits out of the capacity of 16 Mbits of the SDRAM 160 is used as the region for the display unevenness correction data (refer to FIG. 1).

After completion of writing of the display unevenness correction data for three-dimensional display into the SDRAM 160, the display unevenness correcting unit 122 and the overdrive unit 126 operate as follows. The display unevenness correcting unit 122 performs a correcting operation process on an input image signal while reading the display unevenness correction data from the SDRAM 160 via the SDRAM interface unit 170. At this time, the decoder 61 decodes the display unevenness correction data in accordance with the display mode. Specifically, in consideration that the display unevenness correction data stored in the SDRAM 160 is compressed at a compression ratio for three-dimensional display (the relatively high compression degree), the display unevenness correction data is decoded. On the basis of the data subjected to the gamma correction by the gamma correcting unit 124 and the data of the immediately preceding frame (previous frame data) stored in the SDRAM 160, the overdrive unit 126 generates write gray scale data with reference to the overdrive look-up table. At this time, the decoder 62 decodes the previous frame data in accordance with the display mode. Specifically, in consideration that the previous frame data stored in the SDRAM 160 is compressed at the compression ratio for three-dimensional display (the relatively low compression degree), the previous frame data is decoded. The overdrive unit 126 writes the generated write gray scale data into the SDRAM 160 so as to be provided for a process in the following frame. At this time, the encoder 63 encodes the write gray scale data in accordance with the display mode. That is, the write gray scale data is compressed at the compression ratio for three-dimensional display (the relatively low compression degree). By compressing the write gray scale data of one frame at the relatively low compression degree and writing the compressed data into the SDRAM 160, the capacity of 12 Mbits out of the 16 Mbits of the SDRAM 160 is used as the region for the overdrive data (refer to FIG. 1).

1.3.3 Compression Ratio

Next, the compression ratio of the overdrive data (except for the overdrive look-up table) during the 2D mode and the 3D mode will be described. It is assumed here that the screen of full high-vision (screen resolution: 1920×1080) is employed, one pixel is constituted by sub-pixels of three colors of R (red), G (green), and B (blue), and data for each sub-pixel is of 8 bits. The data size (the number of bits) for one frame is "1920×1080×3×8=49,766,400", that is, about 48 Mbits.

During the 2D mode, the capacity of 8 Mbits in the SDRAM 160 is used as the storage region for the overdrive data. Therefore, the compression ratio of the overdrive data during the 2D mode is about 1/6 (=8 M/about 48 M). On the other hand, during the 3D mode, the capacity of 12 Mbits in the SDRAM 160 is used as the storage region for the overdrive data. Therefore, the compression ratio of the overdrive data during the 3D mode is about 1/4 (=12 M/about 48 M).

As described above, the display unevenness correction data is compressed at the relatively low compression degree during the 2D mode, and is compressed at the relatively high compression degree during the 3D mode. Consequently, as the storage region for the display unevenness correction data, the relatively large capacity in the SDRAM 160 is used during the 2D mode, and the relatively small capacity in the SDRAM 160 is used during the 3D mode. That is, when the capacity for storing the display unevenness correction data out of the capacity of the SDRAM 160 is defined as a first capacity, the first capacity during the 2D mode is set to be larger than that during the 3D mode. In a manner opposite to the display unevenness correction data, the overdrive data is compressed at the relatively high compression degree during the 2D mode, and is compressed at the relatively low compression degree during the 3D mode. Thus, as the storage region for the overdrive data, the relatively small capacity in the SDRAM 160 is used during the 2D mode, and the relatively large capacity in the SDRAM 160 is used during the 3D mode. That is, when the capacity for storing the overdrive data out of the capacity of the SDRAM 160 is defined as a second capacity, the second capacity during the 3D mode is set to be larger than that during the 2D mode.

1.4 Effect

In the present embodiment, in the SDRAM 160 provided in the timing controller IC 100, the data compressed at the compression ratio which varies between the 2D mode and the 3D mode is stored. Specifically, as for the display unevenness correction data, when it is stored in the SDRAM 160, it is compressed at the relatively low compression degree during the 2D mode and is compressed at the relatively high compression degree during the 3D mode. On the other hand, as for the overdrive data, when it is stored in the SDRAM 160, it is compressed at the relatively high compression degree during the 2D mode and is compressed at the relatively low compression degree during the 3D mode. In such a manner, during the 2D mode, with respect to the capacity of 16 Mbits of the SDRAM 160, the capacity of 8 Mbits is used as the storage region for the display unevenness correction data, and the capacity of 8 Mbits is used also as the storage region for the overdrive data. On the other hand, during the 3D mode, with respect to the capacity of 16 Mbits of the SDRAM 160, the capacity of 4 Mbits is used as the storage region for the display unevenness correction data, and the capacity of 12 Mbits is used as the storage region for the overdrive data.

As described above, the overdrive data is compressed at the relatively high compression degree during the 2D mode and is compressed at the relatively low compression degree during the 3D mode. When three-dimensional display is performed, noise caused by a compression error at the time of overdrive is easily visually recognized. In the present embodiment, however, the overdrive is performed by using the overdrive data compressed at the relatively low compression degree during the 3D mode, so that occurrence of noise is suppressed. During the 3D mode, the display unevenness correction is performed by using the display unevenness correction data compressed at the compression degree higher than that during the 2D mode. Regarding this point, during the 3D mode, glasses for watching a three-dimensional image are used and a black image is inserted, so that the brightness is lower than that during the 2D mode. Consequently, during the 3D mode, display unevenness is not easily visually recognized. Therefore, even when the display unevenness correction is performed by using the display unevenness correction data compressed at the relatively high compression degree during the 3D mode, the display quality does not largely deteriorate. The necessary memory capacity during the 3D mode is equal to that during the 2D mode. Consequently, in the liquid crystal display apparatus capable of displaying an image in two display modes of two-dimensional display and three-dimensional display, noise at the time of the three-dimensional display can be reduced without increasing the memory capacity.

1.5 Modifications

1.5.1 First Modification

Figure 6:
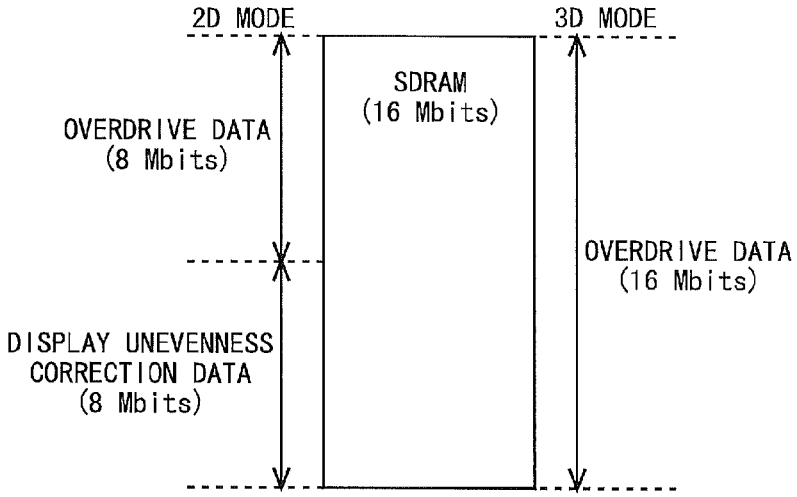
FIG. 6 is a diagram for explaining a use of an SDRAM in a first modification of the first embodiment.

FIG. 6 is a diagram for explaining the use of the SDRAM 160 in a first modification of the first embodiment. Regarding the capacity of 16 Mbits of the SDRAM 160, in the first embodiment, during the 3D mode, the capacity of 12 Mbits is used as the storage region for the overdrive data, and the capacity of 4 Mbits is used as the storage region for the display unevenness correction data. On the other hand, in the modification, during the 3D mode, all of the capacity of the 16 Mbits of the SDRAM 160 is used as the storage region for the overdrive data. Consequently, in the modification, the process by the display unevenness correcting unit 122 is stopped during the 3D mode (that is, the function of the display unevenness correction is set to "off").

In the modification, during the 3D mode, as the storage region for the overdrive data, the capacity of 16 Mbits of the SDRAM 160 is used. Therefore, the compression ratio of the overdrive data during the 3D mode is about 1/3 (=16 M/about 48 M). In such a manner, when overdrive data is stored in the SDRAM 160 during the 3D mode, the overdrive data is compressed at the compression degree lower than that in the first embodiment.

In the modification, the display unevenness correction is not performed during the 3D mode. Consequently, there is a possibility of deterioration in the display quality during the 3D mode. However, since the display unevenness correction data for three-dimensional display becomes unnecessary, it is sufficient to store only data for two-dimensional display as the display unevenness correction data in the flash memory 200. Since the write data into the flash memory 200 is reduced in such a manner, effects of improvement in the production efficiency and cost reduction are obtained as compared with the first embodiment.

1.5.2 Second Modification

Figure 7:
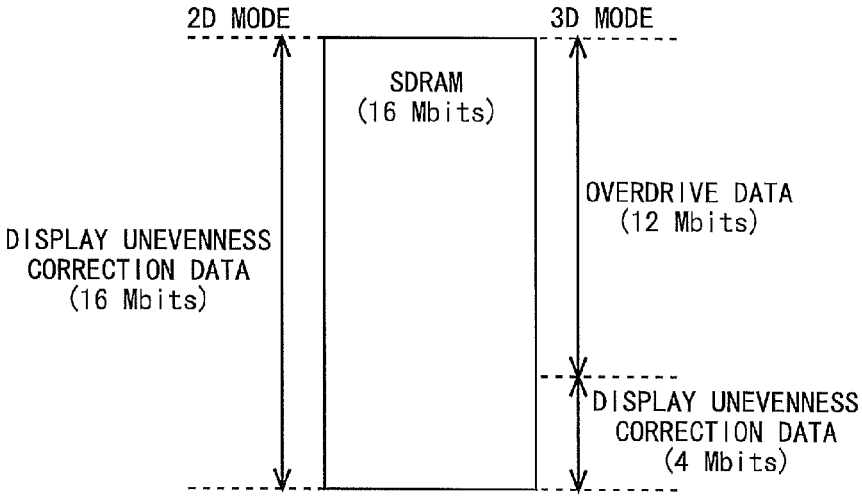
FIG. 7 is a diagram for explaining a use of an SDRAM in a second modification of the first embodiment.

FIG. 7 is a diagram for explaining the use of the SDRAM 160 in a second modification of the first embodiment. In the first modification, all of the capacity of 16 Mbits of the SDRAM 160 is used as the storage region for the overdrive data during the 3D mode. In the present modification, all of the capacity of 16 Mbits of the SDRAM 160 is used as the storage region for the display unevenness correction data during the 2D mode. In such a manner, in a liquid crystal display apparatus capable of displaying an image in the two display modes of two-dimensional display and three-dimensional display, it is also possible not to perform overdrive only when the two-dimensional display is performed. Consequently, for example, an effect that the process load is reduced at the time of two-dimensional display is obtained.

2. Second Embodiment 2.1 Configuration and the Like

Figure 8:
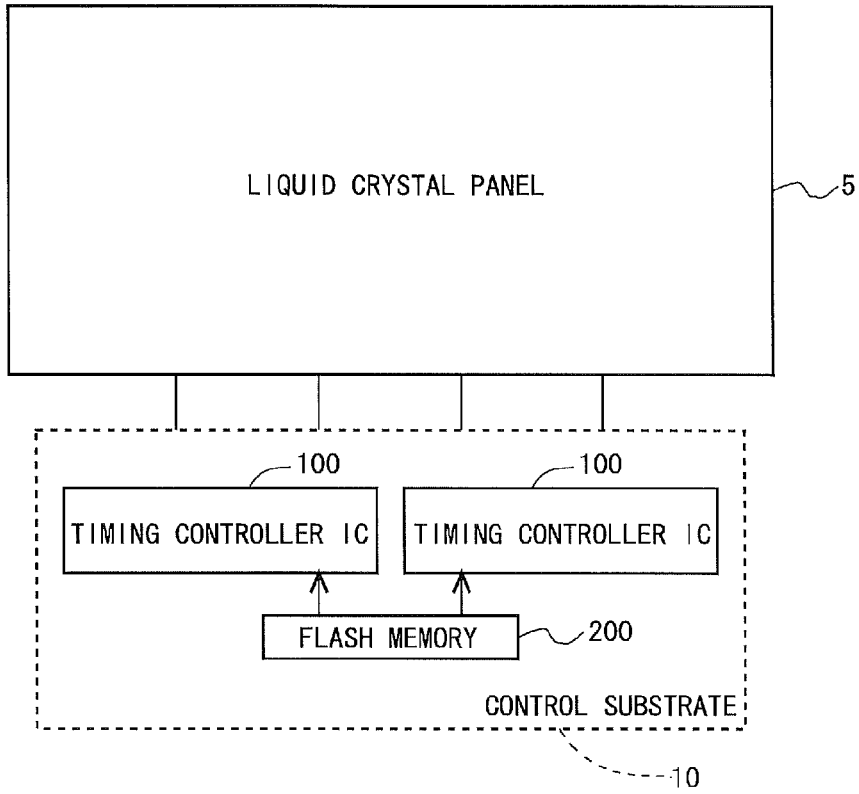
FIG. 8 is a block diagram illustrating a schematic configuration of a liquid crystal display apparatus according to a second embodiment of the present invention.

FIG. 8 is a block diagram illustrating a schematic configuration of a liquid crystal display apparatus according to a second embodiment of the present invention. As illustrated in FIG. 8, in the present embodiment, two timing controller ICs 100 are mounted on the control substrate 10. It should be noted that the general configuration and the configuration of the timing controller IC are similar to those of the first embodiment (refer to FIGS. 2 and 3). In a manner similar to the first embodiment, two display modes of two-dimensional display and three-dimensional display are prepared in the liquid crystal display apparatus, and the display part in the liquid crystal panel 5 can display an image in the two-dimensional display or the three-dimensional display in accordance with the display mode.

By the way, in the liquid crystal display apparatus capable of performing three-dimensional display, in many cases, so-called quad-speed drive (a frame frequency is 240 Hz) is performed. Also in the liquid crystal display apparatus of the present embodiment, the quad-speed drive is performed. In order to realize the quad-speed drive, the two timing controller ICs 100 for double speed drive are mounted on the control substrate 10 as described above in the present embodiment. Each of the two timing controller ICs 100 controls image display in the region of the half of the liquid crystal panel 5. That is, each of the timing controller ICs 100 performs a process for data corresponding to the half of resolution of the liquid crystal panel 5.

2.2 Use of Memory (SDRAM)

Figure 9:
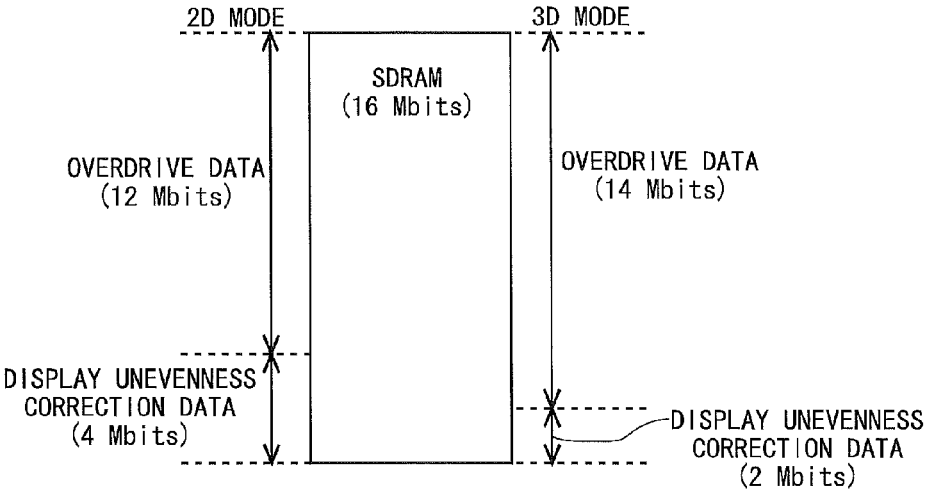
FIG. 9 is a diagram for explaining a use of an SDRAM in the second embodiment.

Next, with reference to FIG. 9, the use of the SDRAM 160 in the present embodiment will be described. It is assumed that the data size of one frame in the entire liquid crystal panel 5 and the capacity of the SDRAM 160 are similar to those in the first embodiment.

In the present embodiment, the data size (the number of bits) for one frame processed by one timing controller IC 100 is "(1920×1080×3×8)/2=24,883,200", that is, about 24 Mbits. Since the data size for one frame processed by one timing controller IC 100 is the half of that in the first embodiment, even when the storage region for the display unevenness correction data is set to the half of that of the first embodiment with respect to the capacity of the SDRAM 160, the display unevenness correction is performed at precision similar to that in the first embodiment. Accordingly, in the present embodiment, regarding the capacity of 16 Mbits of the SDRAM 160, as illustrated in FIG. 9, the capacity of 4 Mbits is used as the region for the display unevenness correction data during the 2D mode, and the capacity of 2 Mbits is used as the region for the display unevenness correction data during the 3D mode.

The capacity except for the region of the display unevenness correction data out of the capacity of 16 Mbits of the SDRAM 160 can be used as the storage region for overdrive data. Therefore, in the present embodiment, as illustrated in FIG. 9, the capacity of 12 Mbits is used as the region for the overdrive data during the 2D mode, and the capacity of 14 Mbits is used as the region for the overdrive data during the 3D mode. As described above, the data size for one frame processed by one timing controller IC 100 is about 24 Mbits. Therefore, the compression ratio of the overdrive data during the 2D mode is about the half (=12 M/about 24 M), and the compression ratio of the overdrive data during the 3D mode is about 0.58 (=14 M/about 24 M).

2.3 Effect

According to the present embodiment, while sufficiently maintaining the precision of display unevenness correction, a larger memory is used as a storage region for overdrive data during both of the 2D mode and 3D mode. Consequently, in a liquid crystal display apparatus capable of displaying an image in two display modes of two-dimensional display and three-dimensional display, noise at the time of three-dimensional display can be reduced more effectively without increasing memory capacity.

3. Others

Although the embodiments have been described by using numerical values with respect to the data size for one frame, compression ratios of display unevenness correction data and overdrive data during each of the modes, and the like, the numerical values are an example and the present invention is not limited to the numerical values indicated in the foregoing embodiments.

Although the flash memory 200 is employed as a nonvolatile memory and the SDRAM 160 is employed as a volatile memory in each of the foregoing embodiments, the present invention is not limited to the embodiments. A memory (for example, EEPROM) other than the flash memory 200 may be employed as a nonvolatile memory, and a memory (for example, SRAM) other than the SDRAM 160 may be employed as a volatile memory.

Further, in the second embodiment, the liquid crystal panel 5 is driven by using the two timing controller ICs 100. However, the number of timing controller ICs 100 is not limited to two. The present invention can be applied also to a configuration in which driving the liquid crystal panel 5 is performed by using three or more timing controller ICs 100.

DESCRIPTION OF REFERENCE CHARACTERS

5: LIQUID CRYSTAL PANEL
10: CONTROL SUBSTRATE
61, 62: DECODER
63: ENCODER

64: WRITE GRAY SCALE DETERMINING UNIT
100: TIMING CONTROLLER IC
120: DATA PROCESSING UNIT
122: DISPLAY UNEVENNESS CORRECTING UNIT
124: GAMMA CORRECTING UNIT
126: OVERDRIVE UNIT
150: TIMING CONTROL UNIT
160: SDRAM
170: SDRAM INTERFACE UNIT
200: FLASH MEMORY
300: SOURCE DRIVER
400: GATE DRIVER
500: DISPLAY UNIT
MD: MODE SIGNAL
PD: PREVIOUS FRAME DATA
WD: WRITE GRAY SCALE DATA

The invention claimed is:

1. A display control circuit for generating write gray scale data to be supplied to a display panel that displays an image in two display modes of two-dimensional display and three-dimensional display, based on an image signal sent from an outside, the display control circuit comprising:

display unevenness correcting circuitry that performs a correction to the image signal to suppress occurrence of display unevenness at the time of displaying an image on the display panel;

overdrive circuitry that performs a correction to emphasize a temporal change of a signal to the image signal corrected by the display unevenness correcting circuitry, and that generates the write gray scale data; and a volatile memory that stores display unevenness correction data as data used for a process by the display unevenness correcting circuitry and overdrive data as data used for a process by the overdrive circuitry, wherein when a capacity for storing the display unevenness correction data out of a capacity of the volatile memory is defined as a first capacity, and a capacity for storing the overdrive data out of the capacity of the volatile memory is defined as a second capacity, the first capacity during the two-dimensional display is larger than that during the three-dimensional display, and the second capacity during the three-dimensional display is larger than that during the two-dimensional display.

2. The display control circuit according to claim 1, wherein the display unevenness correction data compressed at a compression ratio which varies depending on a display mode is stored in the first capacity, and the overdrive data compressed at a compression ratio which varies depending on a display mode is stored in the second capacity.

3. The display control circuit according to claim 2, wherein the overdrive circuitry compresses the write gray scale data at a compression ratio which varies depending on a display mode and writes the compressed write gray scale data as a part of the overdrive data into the volatile memory.

4. The display control circuit according to claim 2, wherein a mode signal indicative of a display mode is supplied to the display unevenness correcting circuitry and the overdrive circuitry, the display unevenness correcting circuitry restores the display unevenness correction data stored in the volatile memory in accordance with a display mode indicated by the mode signal, and the overdrive circuitry restores the overdrive data stored in the volatile memory in accordance with a display mode indicated by the mode signal.

5. The display control circuit according to claim 2, wherein a mode signal indicative of a display mode is supplied to the display unevenness correcting circuitry and the overdrive circuitry, the display unevenness correcting circuitry restores the display unevenness correction data stored in the volatile memory in accordance with a display mode indicated by the mode signal, and the overdrive circuitry compresses the write gray scale data at a compression ratio in accordance with a display mode indicated by the mode signal, writes the compressed write gray scale data as a part of the overdrive data into the volatile memory, and restores the overdrive data stored in the volatile memory in accordance with a display mode indicated by the mode signal.

6. The display control circuit according to claim 1, wherein when three-dimensional display is performed, a process by the display unevenness correcting circuitry is stopped, and the magnitude of the first capacity is set to zero.

7. The display control circuit according to claim 1, wherein when two-dimensional display is performed, a process by the overdrive circuitry is stopped, and the magnitude of the second capacity is set to zero.

8. A liquid crystal display apparatus comprising:

the display control circuit according to claim 1; and a liquid crystal display panel that displays an image based on write gray scale data supplied from the display control circuit, the liquid crystal display panel including a plurality of video signal lines that transmit a plurality of video signals corresponding to the write gray scale data, a plurality of scanning signal lines crossing the plurality of video signal lines, a plurality of pixel formation portions disposed in a matrix along the plurality of video signal lines and the plurality of scanning signal lines, a common electrode that supplies a common potential to the plurality of pixel formation portions, a video signal line drive circuit that drives the plurality of video signal lines, and a scanning signal line drive circuit that drives the plurality of scanning signal lines.

9. The liquid crystal display apparatus according to claim 8, further comprising a nonvolatile memory in which display unevenness correction data for two-dimensional display and display unevenness correction data for three-dimensional display compressed at compression ratios different from each other are stored, wherein when a power supply is turned on or when the display mode is switched, the display unevenness correction data in accordance with the display mode is read from the nonvolatile memory, and the read display unevenness correction data is written into the volatile memory.

10. The liquid crystal display apparatus according to claim 9, wherein a look-up table which configures a part of the overdrive data is further stored in the nonvolatile memory, and when a power supply is turned on, the look-up table is read from the nonvolatile memory, and the read look-up table is written into the volatile memory.

11. The liquid crystal display apparatus according to claim 8, further comprising n pieces (n denotes an integer of two or larger) of the display control circuits integrated, wherein each of the display control circuits generates write gray scale data corresponding to an image to be displayed in a region of substantially 1/n of an image display region of the liquid crystal display panel.

12. The liquid crystal display apparatus according to claim 11, wherein the n is two and a frame frequency is 240 Hz.

13. A display control method of generating write gray scale data to be supplied to a display panel capable of displaying an image in two display modes of two-dimensional display and three-dimensional display based on an image signal sent from an outside, the display control method comprising:

a display unevenness correcting step of performing a correction to the image signal for suppressing occurrence of display unevenness at the time of displaying an image on the display panel; and an overdrive step of performing a correction for emphasizing a temporal change of a signal to the image signal corrected in the display unevenness correcting step, and generating the write gray scale data, wherein when a capacity for storing display unevenness correction data out of a capacity of the volatile memory is defined as a first capacity, and a capacity for storing overdrive data out of the capacity of the volatile memory is defined as a second capacity, the volatile memory being provided for storing the display unevenness correction data as data used for a process in the display unevenness correcting step and the overdrive data as data used for a process in the overdrive step, the first capacity during the two-dimensional display is larger than that during the three-dimensional display, and the second capacity during the three-dimensional display is larger than that during the two-dimensional display.

* * * * *